US005406990A

United States Patent [19]

Haeberli

[11] Patent Number: 5,406,990

[45] Date of Patent: Apr. 18, 1995

[54] PROCESS AND MACHINE FOR FILLING CONTAINERS WITH COSMETIC PRODUCTS EVEN HAVING DIFFERENT CHARACTERISTICS

[75] Inventor: Adrian Haeberli, Zürich, Switzerland

[73] Assignee: Aktiengesellschaft für Geld-und Kapitalanlagen, Samedan, Sweden

[21] Appl. No.: 216,329

[22] Filed: Mar. 23, 1994

[30] Foreign Application Priority Data

Mar. 31, 1993 [IT] Italy ..... MI93A0632

[51] Int. Cl.[6] ..... B65B 1/20

[52] U.S. Cl. ..... 141/12; 141/71; 141/73; 141/101; 141/125; 141/137; 141/280; 53/436

[58] Field of Search ..... 141/12, 71, 72, 81, 141/101, 125, 137, 172, 258, 259, 280; 53/436, 439, 529

[56] References Cited

U.S. PATENT DOCUMENTS 3,321,317 5/1967 Carruthers ..... 141/81
3,847,191 11/1974 Aronson ..... 141/71
4,542,835 9/1985 Gamberini ..... 141/12
4,594,066 6/1986 Graham ..... 53/529
5,287,897 2/1994 Gamberini ..... 141/73

FOREIGN PATENT DOCUMENTS 0561444 9/1993 European Pat. Off. .
2359093 6/1974 Germany .

*Primary Examiner*—Henry J. Recla
*Assistant Examiner*—Steven O. Douglas
*Attorney, Agent, or Firm*—Jacobson, Price, Holman & Stern

[57] ABSTRACT

A process and a machine are described for filling containers with cosmetic products even having different characteristics. The machine comprises at least one unit that executes a succession of similar processing cycles, each of which comprises the loading of at least one loading cell with a cosmetic product, and the levelling of the cosmetic product itself inside the loading cell, the transfer and compacting of the cosmetic product loaded inside the loading cell inside a pick-up cell, the transfer of the compacted cosmetic product from the pick-up cell to a collection container and the final pressing of the compacted cosmetic product in the collection container itself.

6 Claims, 4 Drawing Sheets

PROCESS AND MACHINE FOR FILLING CONTAINERS WITH COSMETIC PRODUCTS EVEN HAVING DIFFERENT CHARACTERISTICS

DESCRIPTION

The present invention has as the object a process and a machine for filling containers with cosmetic products even having different characteristics.

A process and a machine are known that provide for the formation of tablets of cosmetic product, obtained starting from a levelled layer of cosmetic product, moved by a conveyor belt, through apportionment of the product itself by means of die cutters and subsequent compression of the product itself by means of thrust pistons associated with the die cutters; the tablets are then transferred by the same die cutters inside special containers, located on a rotating support, where they are subjected to a final pressing.

A machine for executing the abovementioned process is, however, complicated and expensive. Due to the type of pick-up made, it is, moreover, exposed to drawbacks such as spreading of cosmetic product with residues outside the die cutter, and in general to problems of cleanliness.

A further problem with which such machine is afflicted is linked with the fact that the values of pressure exerted by said thrust pistons cannot be very high (they do not usually exceed 300 kg/cm$^2$), due to the flexibility of the conveyor belt; on the other hand, cosmetic products are met in practice with characteristics such as to require even substantial pressures, for example 800 kg/cm$^2$.

Lastly, the use of the abovementioned machine for filling containers with more than one cosmetic products having different characteristics becomes difficult, requiring more than one strip of product to be placed side by side on the conveyor belt; the thrust piston, exerting the same pressure on portions of different products, gives rise to burrs and differences in height, where the latter can be eliminated but partially by a final compression of the product after it has been placed inside the container.

A machine is also known wherein the cosmetic product is loaded directly inside the container, placed in a plate provided with suitable cells for housing the containers themselves; subsequently, again through the use of a thrust piston, the cosmetic product is pressed inside said container.

In view of the described state of the art, the object of the present invention is to provide a process and a machine for filling containers with cosmetic products that do not exhibit the mentioned problems, and that can be applied with ease to simultaneous use with cosmetic products having different characteristics.

According to the present invention, such object is attained thanks to a process for filling containers with cosmetic products, comprising a step wherein at least one loading cell is loaded with a cosmetic product, and the same cosmetic product is levelled inside said loading cell, characterized in that it also comprises the following successive steps:

a) transfer and compacting of said cosmetic product, loaded inside said loading cell, inside a pick-up cell placed over it;

b) transfer of the compacted cosmetic product from said pick-up cell to a collection container and c) final pressing of the compacted cosmetic product inside said container.

According to an embodiment of the process according to the invention there is a repetition of operating cycles, in each of which the abovementioned step of loading the cosmetic product is executed during the step of transferring the compacted product of the previous cycle.

There is also the possibility of executing for the same container a plurality of identical out-of-step cycles for the filling of the abovementioned container with side-by-side portions of different cosmetic products, that are finally subjected to a common final pressing.

According to the invention such object is also attained thanks to a machine for the execution of the abovementioned process, constituted by at least one unit comprising means for feeding and levelling a cosmetic product inside at least one loading cell obtained in an operating surface, characterized in that said unit also comprises a transfer and compacting device that can be moved from a position where it receives the cosmetic product from said loading cell and a position where the cosmetic product is unloaded into a collection container and comprising at least one pick-up cell that can be placed alternately over said loading cell and over said collection container according to the position of said device, thrust means associated with said loading cell to execute the transfer of said cosmetic product from said loading cell to said pick-up cell when said device is in the receiving position and opposing means associated with said pick-up cell to co-operate with said thrust means for compacting the cosmetic product during said transfer of the product itself and to subsequently execute the unloading of the compacted cosmetic product inside said collection container when said movable device is in the unloading position.

A suitable thrust means is also preferably provided for the final pressing of the cosmetic product in the collection container.

It has also been possible to observe experimentally that in the machine according to the invention, as opposed to those known so far, the formation of the tablets of cosmetic product takes place by exerting the proper pressure not on the cosmetic product still in the feeding step, but on the individual portions of cosmetic product already loaded in the loading cells and being transferred to the pick-up cells over them. In this way problems of spillage of cosmetic product are avoided, as well as the consequent problems of cleanliness, It should further be noted that, by suitable adjustment of the stroke of the thrust means and of the opposing means, it is possible to vary the values of pressure exerted on the cosmetic product for its compacting over a wide range, so as to make it possible to use cosmetic products that are even very different one from the other.

These and other features of the present invention will be made more evident by the following detailed description of an embodiment thereof illustrated as a non-limiting example in the enclosed drawings, wherein.

Figure 1:
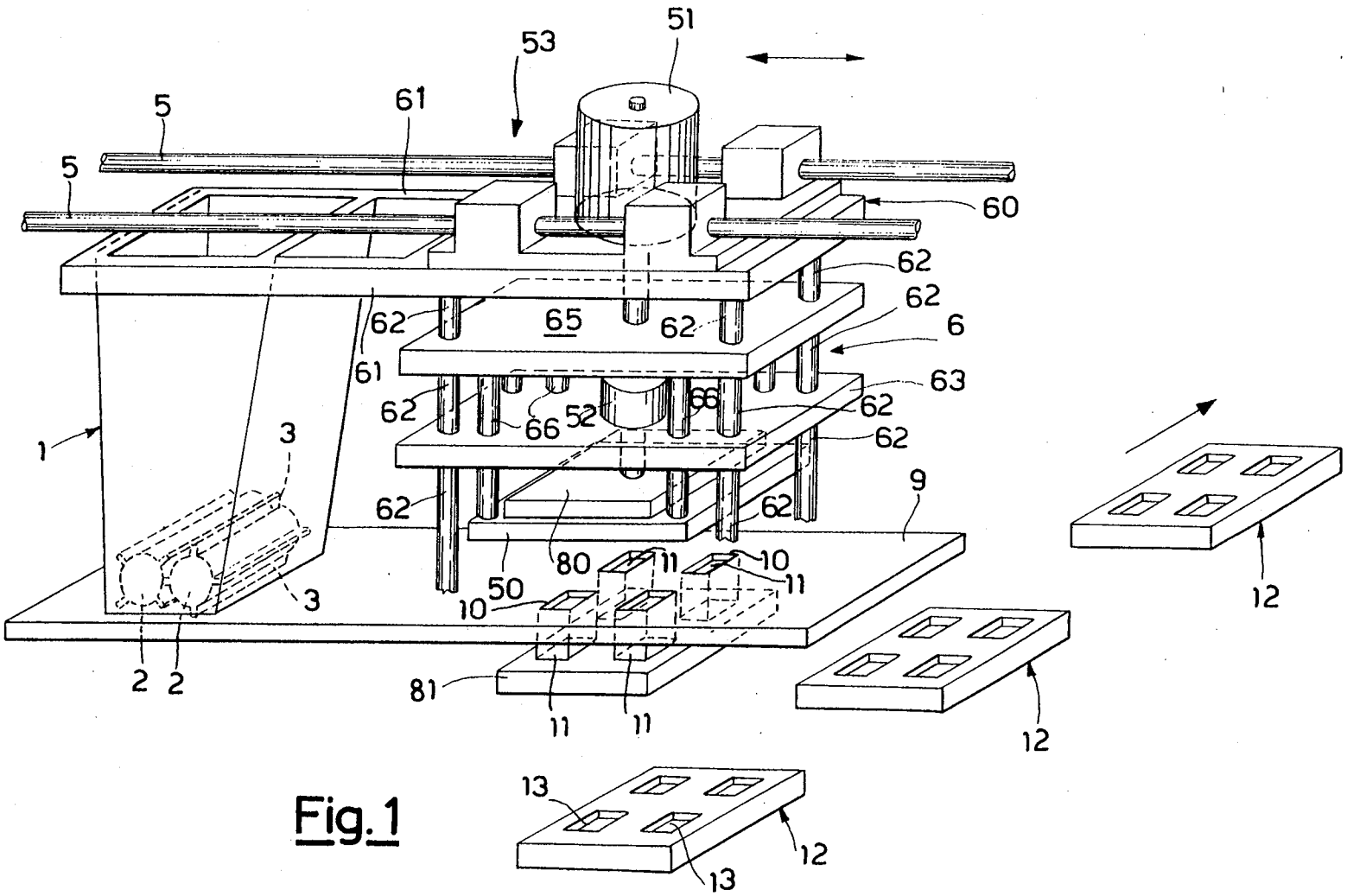
FIG. 1 is a perspective view of a machine according to the invention.
Figure 2:
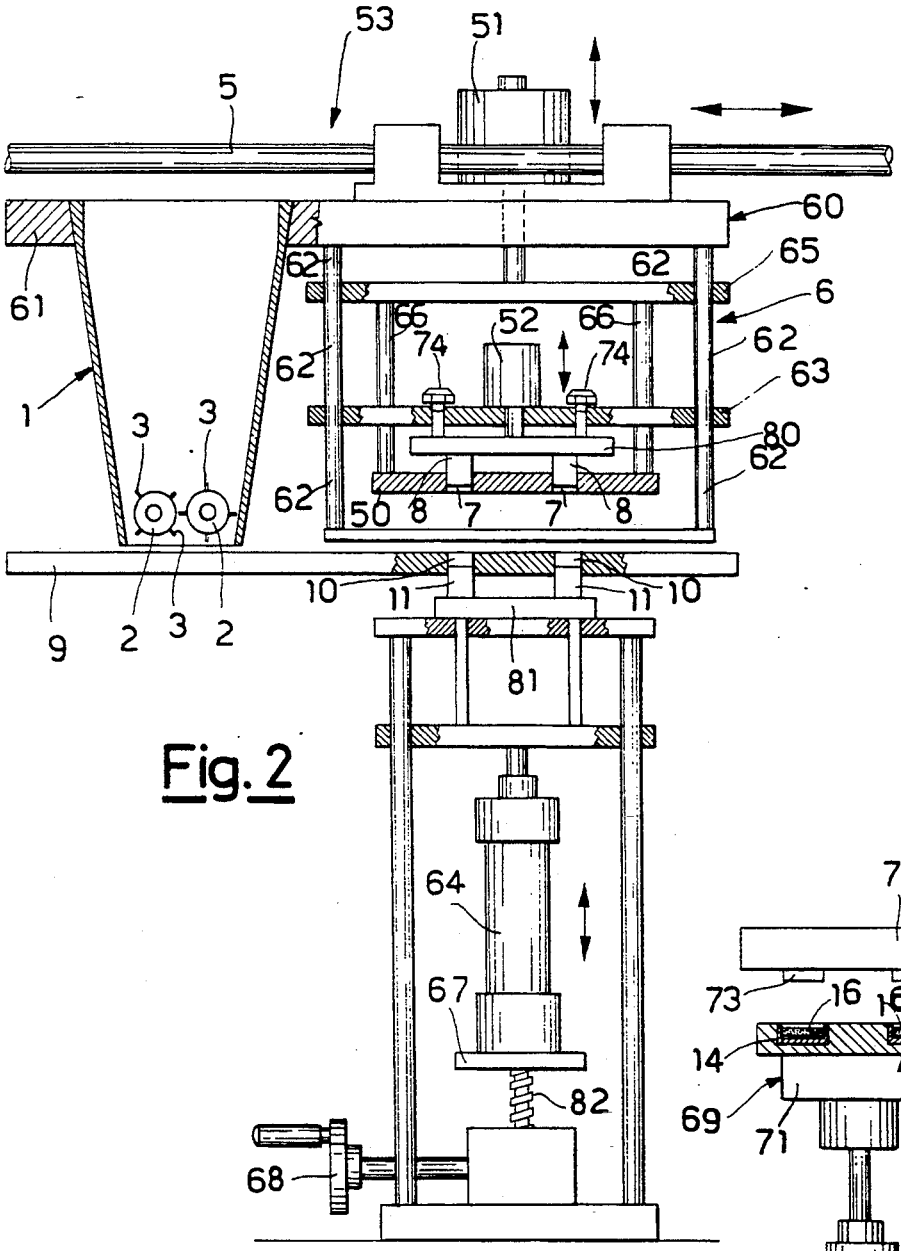
FIG. 2 is a longitudinal cross-section of the machine of FIG. 1.

With reference to FIGS. 1 and 2, a unit 53 forming part of a machine according to the invention comprises a hopper 1, with a pair of rollers 2 inside it, each equipped with a succession of fins 3 arranged radially.

At the top, the hopper 1 is fastened to a pair of supports 61 that make it integral with a transfer and compacting device 60 comprising a supporting frame 6, inside which there is a plate 50, fastened at the top to a first supporting plate 63 that is in turn fastened to a second supporting plate 65 by means of pillars 66; the plate 50, the first supporting plate 63 and the second supporting plate 65 slide vertically, under the action of a pneumatic cylinder 51, along vertical guides 62. Such plate 50 is endowed with a plurality of pick-up cells 7, inside which there are as many sliding opposing pistons 8, constituting the crown of said cells 7, under the action of a single further pneumatic cylinder 52 acting on a plate 80 to the lower surface of which the same opposing pistons 8 are linked. The stroke of the plate 80, and as a consequence of said opposing pistons 8, is limited upward by adjustable screws 74.

At the bottom, the hopper 1 is aligned with a plane 9, in which the loading cells 10 are obtained, in the same number and with the same shape as said pick-up cells 7, and arranged in such a way that, when the abovementioned plate 50 is at its lowest point and the device 60 is in the position of FIGS. 1 and 2, the pick-up cells 7 are exactly over the loading cells 10. Moreover, inside the latter, the thrust pistons 11, constituting the bases of said cells 10, slide under the action of a pneumatic cylinder 64 acting on a plate 81 to the upper surface of which the thrust pistons 11 themselves are linked; in addition, the cylinder 64 is fastened at the bottom on a support 67 whose height can be varied, by rotating a screw 82 by means of a crank 68, with the purpose of consequently varying the stroke of said pistons 11.

The assembly constituted by said transfer and compacting device 60 and by the hopper 1 can slide along a pair of horizontal guides 5.

At the opposite end of the plane 9 with respect to the hopper 1, arranged on a conveyor belt not represented in the figures, there are supports 12 provided with receving holes 13 suitable for receiving containers or bases 14, that are also in the same number and having the same shape as the pick-up cells 7.

Figure 10:
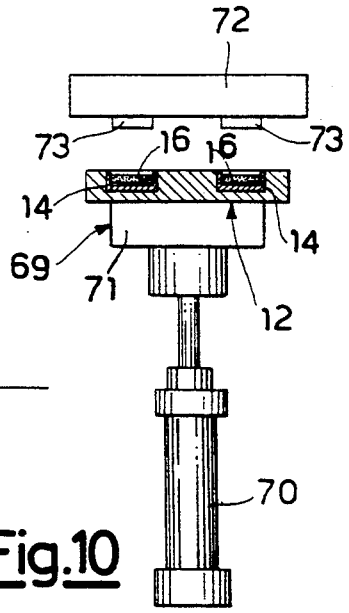
FIG. 10 shows a thrust device for the final pressing of the compacted cosmetic product in collection containers.

As shown in FIG. 10, lastly, a thrust device 69 for the final pressing of the cosmetic product comprises a cylinder 70 acting on a plane 71, suitable for holding the supports 12 containing the bases 14 already filled with cosmetic product and, at the top, a fixed plate 72 provided with matching strikers 73 having the same shape as the bases 14 and exactly superimposed over them.

Figure 3:
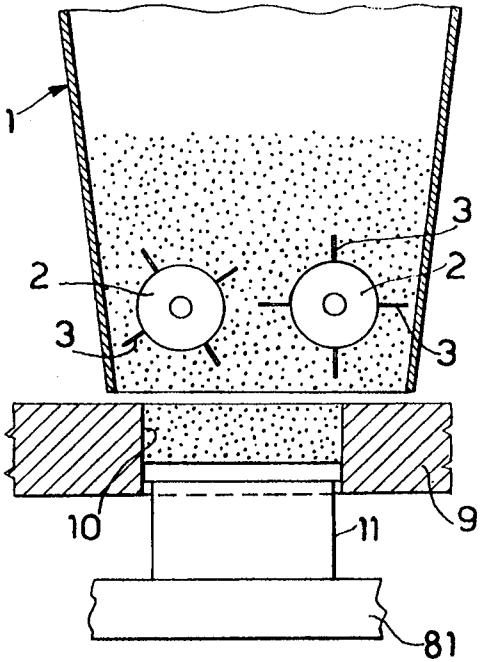

A typical operating cycle of the unit 53 described above starts with the loading of the cosmetic product in the loading cells 10, executed with the device 60 displaced along the guides 5 so that the hopper 1 is over the loading cells 10 as shown in FIG. 3.

Figure 5:
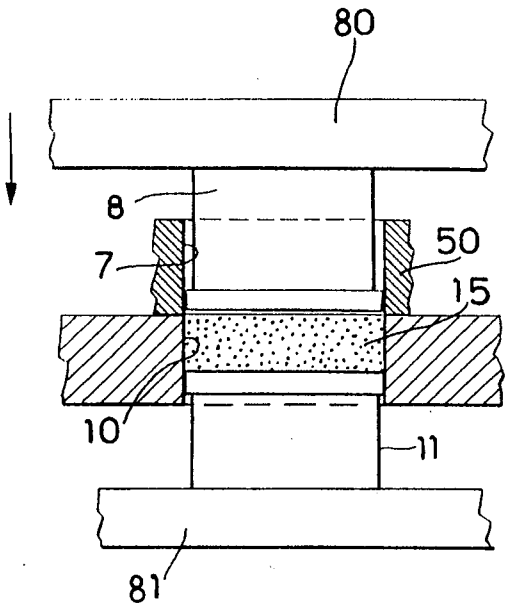
FIGS. 3–9 illustrate in successive positions the enlarged detail of a loading cell, of the corresponding thrust means, of a pick-up cell and of the corresponding opposing means.
Figure 4:
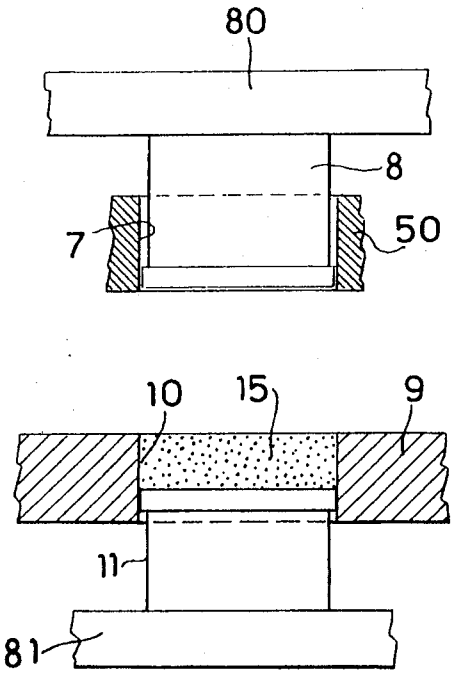

Once the device 60 has been returned to the position of FIGS. 1 and 2, the plate 50 with the pick-up cells 7 is lowered until it rests on the plane 9, so that the pick-up cells 7 are exactly over the loading cells 10, while the opposing pistons 8 arranged themselves by gravity (or by whatever other force) in their position at the lower end of stroke (FIGS. 4 and 5).

Figure 6:
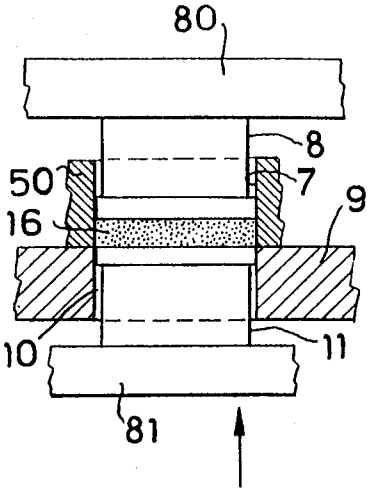

Subsequently the thrust pistons 11, sliding inside the loading cells 10 under the action of the cylinder 64, thrust the cosmetic product 15 inside the pick-up cells 7; the passive resistance offered by the opposing pistons 8, overcome by the thrust exerted by the thrust pistons 11, already during this step allows a compacting action of some types of cosmetic product that are more easily compressed; for those products that require a higher pressure for being compacted, the actual compacting takes place when the opposing pistons 8 are at the upper end of their stroke (determined by the adjustment of the screws 74): the reaction to the thrust of the thrust pistons 11 is exerted by the cylinder 51, that keeps the plate 50 up against the plane 9. At the end of this operation, a sort of tablet 16 of cosmetic product will have been formed inside the pick-up cells (FIG. 6).

Figure 7:
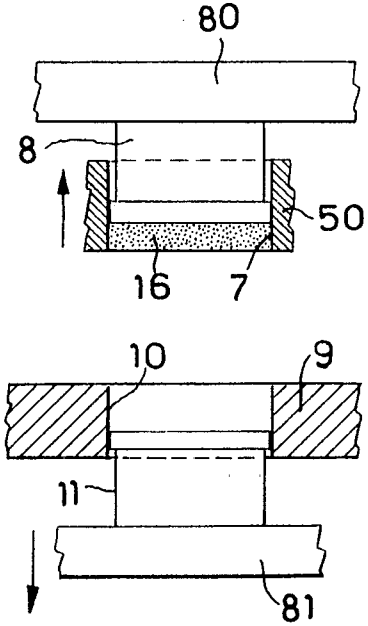

Subsequently the plate 50 is raised, taking with it the tablets 16 held inside the lateral walls of the pick-up cells 7; simultaneously, the thrust pistons 11 are lowered, so as to free the loading cells 10 and to make them available for a new load of cosmetic product (FIG. 7).

The transfer and compacting device 60, together with the hopper 1 integral with it, then proceeds by sliding along the guides 5 towards the extremity of the plane 9, to which the support 12 is simultaneously moved by the conveyor belt. During this same step the hopper 1, moving over the loading cells 10, executes, by means of the rollers 2 and the fins 3 with which they are equipped, a new loading step of cosmetic product 15 inside the cells 10 themselves; said fins 3 also execute a levelling of the cosmetic product 15 inside the loading cells 10, removing, thanks to the special conformation of their terminal part, the excess cosmetic product, and returns it to the hopper 1.

Figure 8:
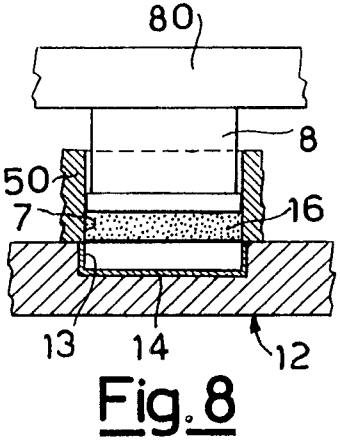

When the device 60 is exactly over the support 12, the plate 50 is once again lowered until it rests up against the support 12 itself (FIG. 8).

Figure 9:
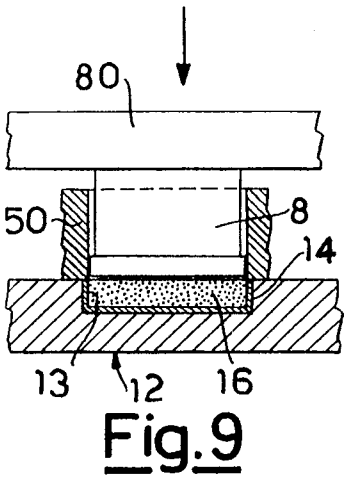

The pneumatic cylinder 52, acting on the plate 80, causes the downward movement of the opposing pistons 8, that gives rise to the transfer of the tablets 16 of cosmetic product inside the bases 14 (FIG. 9).

At this point, the plate 50 moves upward again and both the device 60 and the hopper 1 return to the position indicated in FIG. 1. When the hopper 1 moves over the Loading cells 10, the latter are again loaded with cosmetic product 15, once more by means of the fins 3 of the rollers 2.

After this moment a new cycle can begin of transfer and compacting of the cosmetic product, transfer of the compacted product and unloading of the same inside the bases 14.

The support 12 containing the bases 14 filled with cosmetic product 16 is then transferred, manually or possibly again by means of the conveyor belt, on the plane 71 of the pressing device 69; the upward movement of the plane 71 brought about by the cylinder 70 allows the cosmetic product to be subjected to a final pressing against the matching strikers 73. The containers 14 can then be removed for packaging.

Should it be desired to fill each base 14 with more than one different cosmetic products, such as for example powders of different colour, it is sufficient to arrange in sequence a number of units 53, altogether similar to the one just described, equal to the number of different products with which each of the bases 14 themselves is to filled, and to synchronize the operating cycle in an appropriate manner. The loading cells 10 and the pick-up cells 7 with which each of the units 53 will be provided will have to be of a shape such as to fill with the tablets 16 of cosmetic product only the desired portion of the base 14, such portions being necessarily complementary to one another. The pressing device 69 lastly executes the final pressing of the composite cosmetic product thus obtained.

It should be highlighted that, with the screws 74, it is possible to carry out an independent adjustment of the pressure exerted by the thrust pistons 11 on the cosmetic product in each unit 53, so that differences in height are not created inside the bases 14 as a result of the use of cosmetic products with different characteristics.

Similarly, it is possible to vary the amount of cosmetic product 15 with which the loading cells 10 are loaded, by increasing the stroke of the thrust pistons 11 constituting the base of the loading cells 7 themselves by rotating the crank 68.

I claim:

1. A machine for filling a container with a cosmetic product and having at least one unit comprising cosmetic-product feeding and levelling means for supplying the cosmetic product inside at least one loading cell obtained in an operating surface, wherein said unit also comprises a transfer and compacting device that can be moved between a position where it receives the cosmetic product from said loading cell and a position where the cosmetic product is unloaded into a collection container and comprising at least one pick-up cell that can be placed alternately over said loading cell and over said collection container according to the position of said device, thrust means associated with said loading cell to execute the transfer of said cosmetic product from said loading cell to said pick-up cell when said device is in the receiving position and opposing means associated with said pick-up cell to co-operate with said thrust means for compacting the cosmetic product during said transfer of the product itself and to subsequently execute the unloading of the compacted cosmetic product into said collection container when said movable device is in the unloading position.

2. A machine according to claim 1, characterized in that it comprises a thrust device for final pressing of a tablet of cosmetic product inside the collection container.

3. A machine according to claim 1, characterized in that said thrust means associated with each loading cell comprise a thrust piston, constituting a base of said loading cell.

4. A machine according to claim 1, characterized in that said opposing means associated with each pick-up cell comprise an opposing piston constituting a top of said pick-up cell.

5. A machine according to claim 1, characterized in that said unit comprises a plurality of loading cells and an identical plurality of pick-up cells associated with said transfer and compacting device.

6. A machine according to claim 1, characterized in that it comprises a plurality of identical units mentioned above arranged in sequence along the path where the collection containers are moved.

* * * * *